US007677711B2

(12) United States Patent
Perego

(10) Patent No.: US 7,677,711 B2
(45) Date of Patent: Mar. 16, 2010

(54) INK-FEEDING DEVICE FOR INK-JET PRINTING APPARATUS

(75) Inventor: Luciano Perego, Mezzago (IT)

(73) Assignee: Tapematic S.p.A., Ornago (IT)

( * ) Notice: Subject to any disclaimer, the term of this patent is extended or adjusted under 35 U.S.C. 154(b) by 696 days.

(21) Appl. No.: 11/635,844

(22) Filed: Dec. 8, 2006

(65) Prior Publication Data

US 2007/0146443 A1 Jun. 28, 2007

(30) Foreign Application Priority Data

Dec. 22, 2005 (EP) ..... 05425908

(51) Int. Cl.
*B41J 2/175* (2006.01)

(52) U.S. Cl. ..... 347/85

(58) Field of Classification Search ..... 347/7, 347/29, 30, 85, 86, 87, 102, 156
See application file for complete search history.

(56) References Cited

U.S. PATENT DOCUMENTS 3,913,719 A * 10/1975 Frey ..... 358/1.16
6,783,215 B2 * 8/2004 Yoshida et al. ..... 347/85
6,840,604 B2 * 1/2005 Kimura et al. ..... 347/85
7,048,363 B2 * 5/2006 Kobayashi et al. ..... 347/85
2002/0024543 A1 2/2002 Kimura et al.
2003/0011668 A1 1/2003 Yoshida

FOREIGN PATENT DOCUMENTS

EP 0 733 481 A 9/1996
EP 1 142 713 A 10/2001
JP 2004 203055 A 7/2004

* cited by examiner

*Primary Examiner*—Anh T. N. Vo
(74) *Attorney, Agent, or Firm*—Pearne & Gordon LLP

(57) ABSTRACT

An ink-feeding device for ink-jet printing apparatus comprises an ink-containing tank (2) and at least one print head (7) connected to the tank (2). The device further comprises a metering device (3) interposed between the tank (2) and the print head (7) and provided with an inner space (10) having a planar major extension to keep the pressure of the ink feeding the print head (7) substantially constant and to improve the print quality.

19 Claims, 5 Drawing Sheets

INK-FEEDING DEVICE FOR INK-JET PRINTING APPARATUS

The present invention relates to an ink-feeding device for ink-jet printing apparatus.

In particular, the present invention applies to ink-jet printing apparatus for industrial use such as, by way of example, printing of flat plastic supports like optically readable discs (CD's, DVD's), cards or plastic panels in general.

It is known that ink-jet printing apparatus are available which are adapted for printing on a surface of plastic material articles. These printing apparatus are provided with electronically controlled print heads, which have the function of drawing the ink from a tank and lay it on a support at a suitable speed, in an amount and following modalities depending on the print to be carried out.

The print heads are at least one for each colour used, but it is possible to equip the printing apparatus with two or more heads for each colour.

The heads are mounted on a carriage slidable in a printing direction so that they can reach the points of the article to be printed which in this configuration is maintained stationary.

The ink for feeding the print heads comes from a tank put upstream of the printing apparatus. Generally, the feeding device only consists of a duct connecting a lower portion of each ink tank to the corresponding heads. At the same time as the heads distribute ink onto the article, they recall ink from the tank.

Disadvantageously, as the ink amount in the tank decreases, a worsening in the print quality occurs. In fact, since the tank has a vertical extension of several ten centimeters, the ink pressure at said lower portion, in the duct and the head, is greatly affected by the ink level in the tank itself. In particular, when the ink level in the tank is reduced to few centimeters, the hydrostatic pressure exerted on said ink that is reaching the head is drastically reduced.

This phenomenon gives rise to a bad-quality and uneven print. In fact, the reduced pressure causes undesirable variations in the speed and pressure at which ink is sprayed on the article to be printed. The print will appear irregular and with some regions of the support less coated and therefore lighter.

The Applicant has found that the ink-feeding devices for ink-jet printing apparatus of the above described type can be improved under different points of view, particularly as regards the print quality.

Accordingly, it is an aim of the present invention to propose an ink-feeding device for ink-jet printing apparatus enabling the print quality to be optimised and maintained uniform during the whole printing step. In detail, it is an aim of the present invention to propose a device substantially maintaining the ink pressure constant in the print heads upon variation of the ink level contained in the tank. In particular, it is an aim of the present invention to propose a device ensuring the print quality also when the ink in the tank is about to run dry.

Further features and advantages will become more apparent from the detailed description of a preferred but not exclusive embodiment of an ink-feeding device for ink-jet feeding apparatus in accordance with the present invention.

This description will be set out hereinafter with reference to the accompanying drawings, given by way of non-limiting example, in which.

Figure 1:
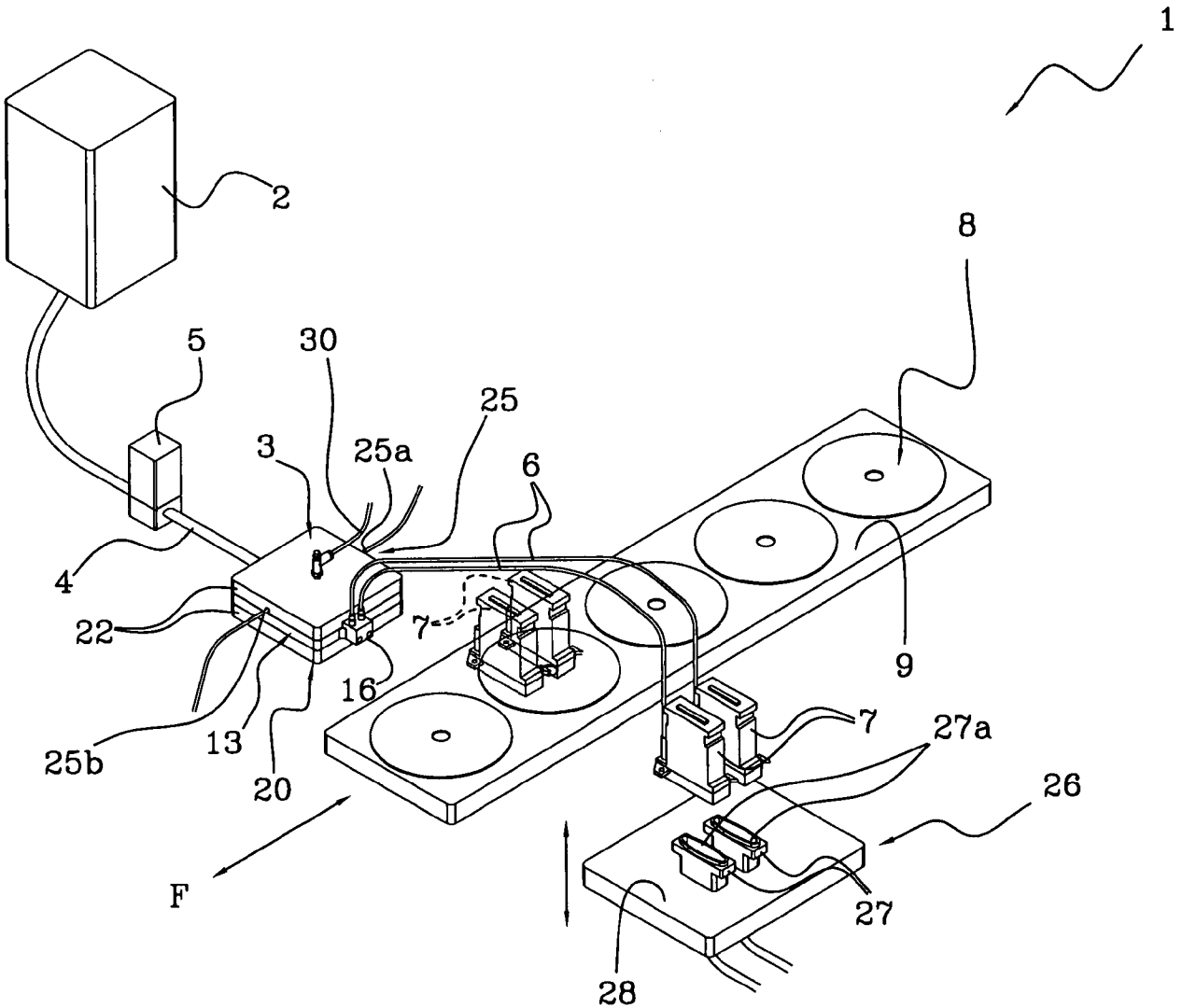
FIG. 1 is a diagrammatic perspective view of an ink-feeding device for ink-jet printing apparatus.
Figure 2:
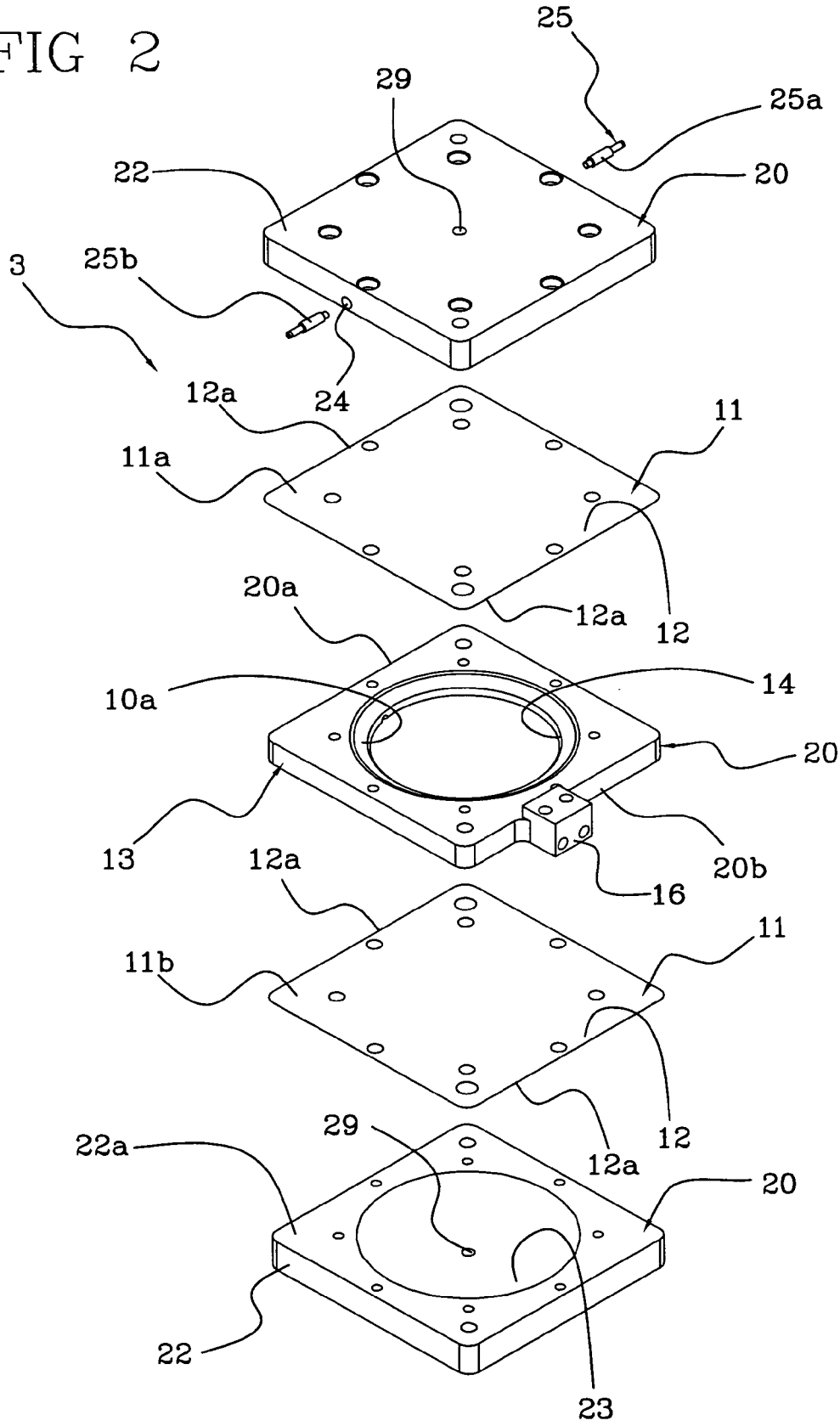
FIG. 2 is an exploded perspective view of a detail of the device seen in FIG. 1.
Figure 3A:
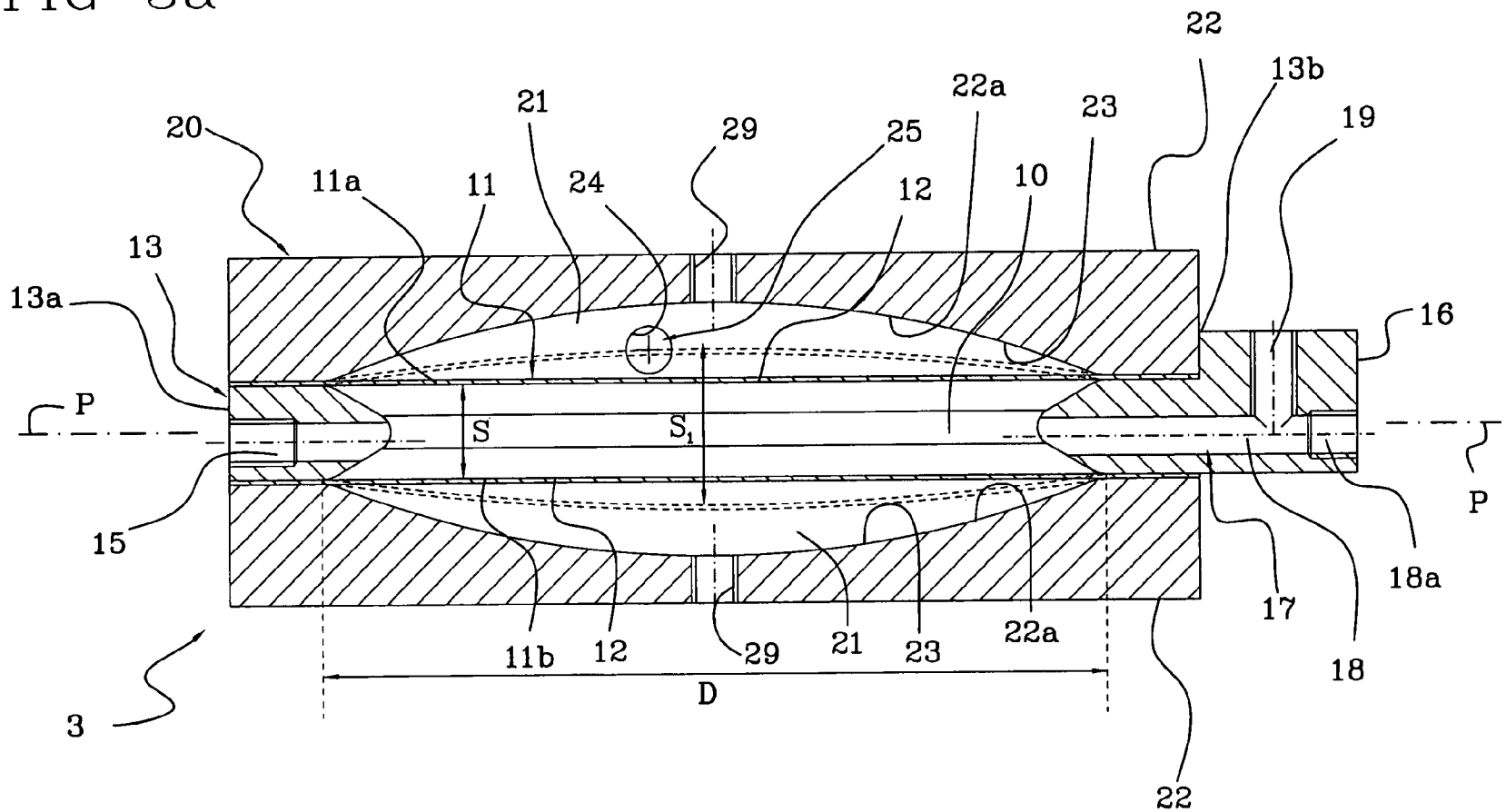
Figure 3B:
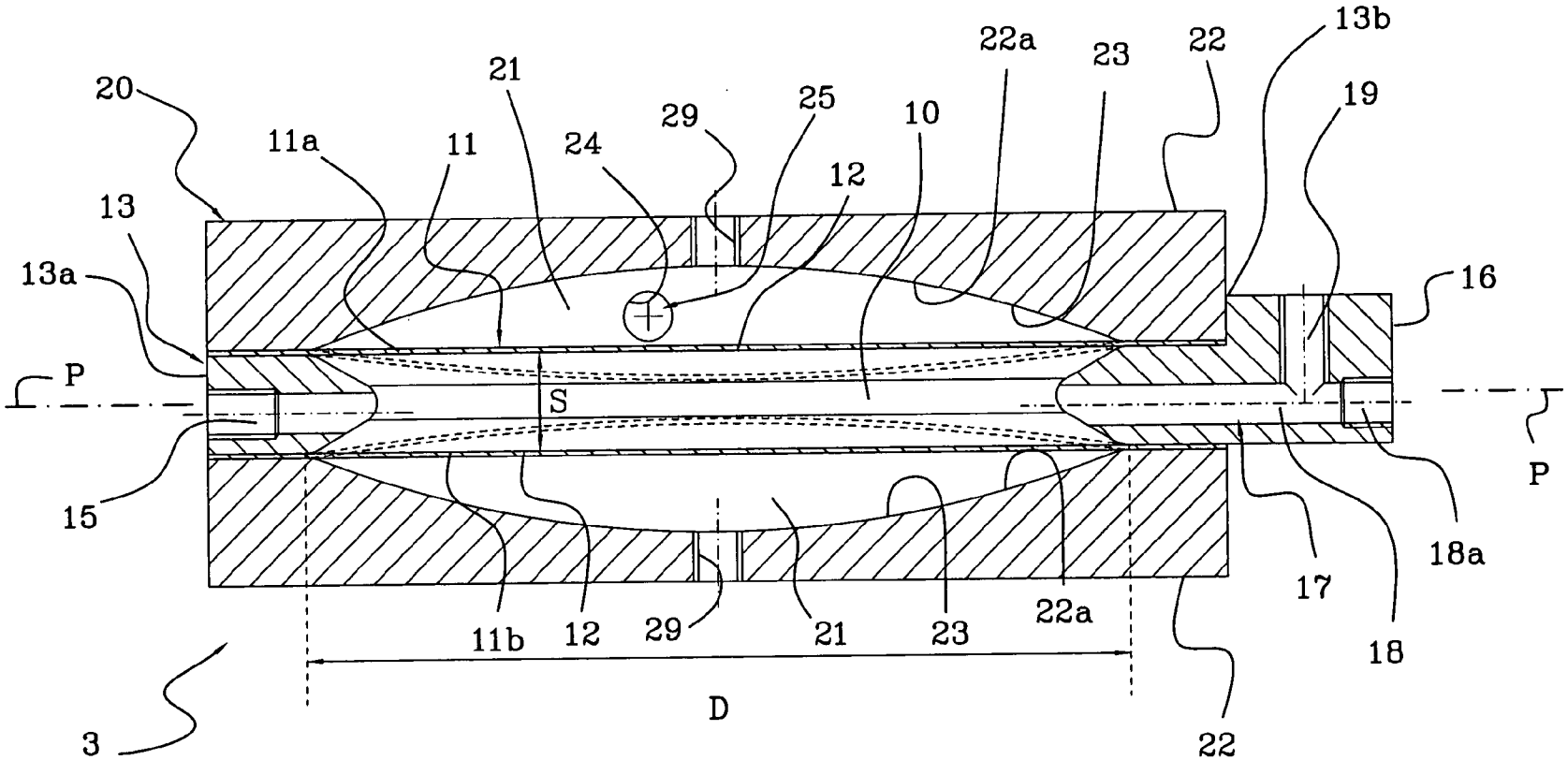
Figure 4:
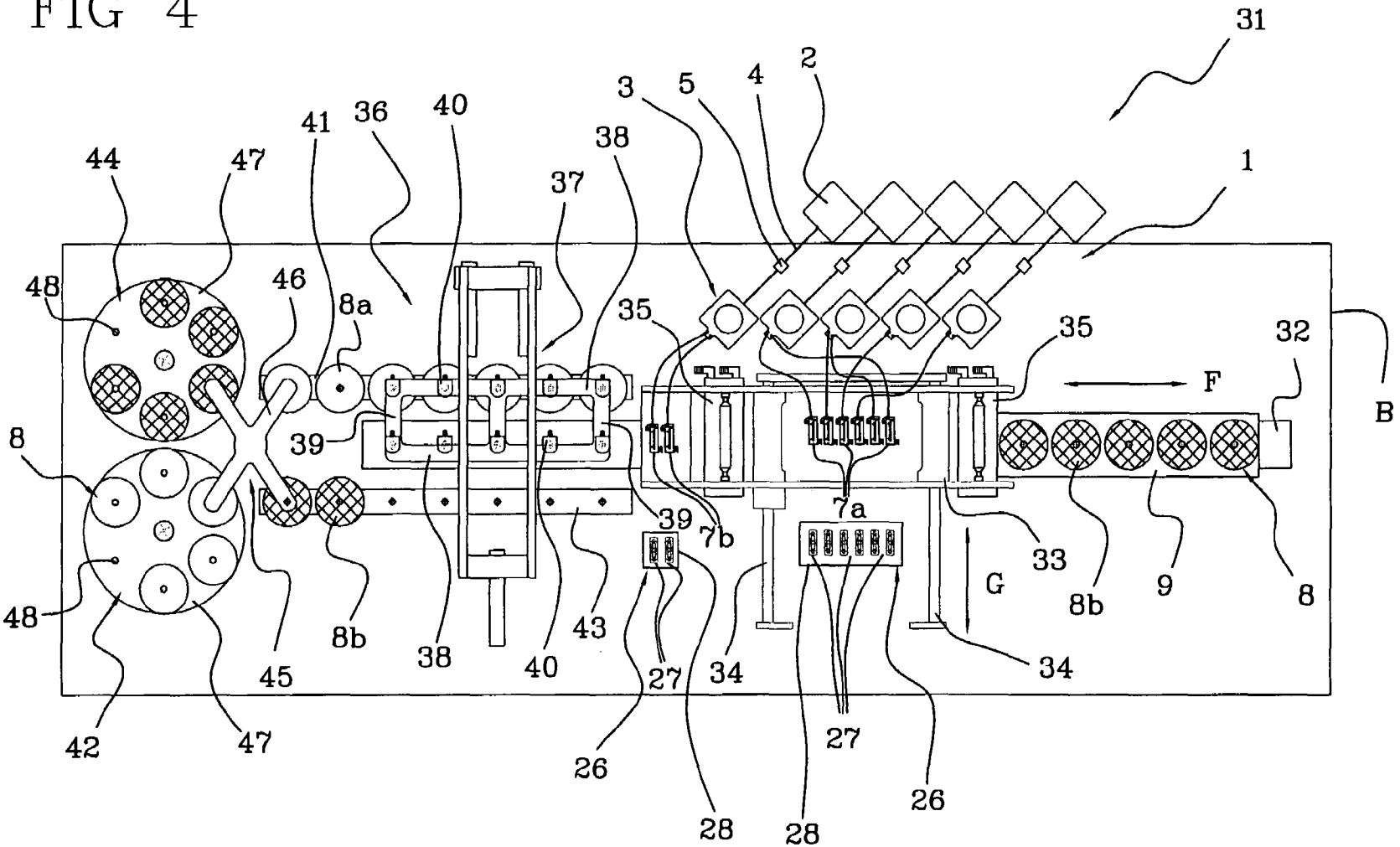

FIGS. 3*a* and 3*b* are section views of the detail seen in FIG. 2 in two distinct operating positions; and FIG. 4 is a diagrammatic view of an ink-jet printing apparatus comprising the device in FIG. 1.

An ink-feeding device for ink-jet printing apparatus in accordance with the present invention has been generally identified by reference numeral 1.

The device 1 comprises a tank 2 containing the ink for printing. Tank 2 is connected to a metering device 3 by a connecting duct 4. An on/off valve 5 is disposed between the tank 2 and the metering device 3 along said duct 4, to enable or prevent passage of the ink flow along the duct 4.

At least one pipe 6 starts from the metering device 3 and is connected to at least one print head 7. In the example herein shown, two pipes 6 start from the metering device 3 and are connected to two print heads 7 fed with ink of the same colour.

The articles 8 are laid on a support or tray 9 driven in relative movement with respect to the heads 7.

The heads 7 are mounted on a movable carriage (not shown) and are electronically controlled by a processor. In printing apparatus of the traditional type, the support 9 carrying the articles 8 is fixed and the carriage carrying the heads 7 is movable in a predetermined printing direction so that the whole surface of articles 8 can be reached.

However, in the example shown, the support 9 is slidably movable in the printing direction "F" and the carriage is movable in a direction "G" perpendicular to the printing direction "F". In more detail, the support 9 defines a reciprocating motion along the direction "F" so as to repeatedly take the articles 8 under the print heads 7 to enable full printing of said articles 8 in several steps.

In fact, each head 7 lays an ink band on articles 8, which is of smaller width than that of said articles. Therefore, each article 8 is to be brought again under the heads 7 and said heads 7 are to be shifted in the direction "G" to enable them to be over a region devoid of ink.

The metering device 3 is therefore interposed between the tank 2 and heads 7.

The metering device 3 is provided with an inner space 10 having a mainly planar extension. In other words, the flat sizes of the metering device are much more extended than its vertical size.

This solution enables laying of the ink with a reduced thickness. In this way, the hydrostatic-pressure variation exerted by the ink contained in the space 10 becomes negligible.

In more detail, the inner space 10 is of a varying volume. In fact, said space 10 is defined by walls 11 that are movable between a first configuration at which said walls 11 are to their maximum mutual distance (FIG. 3*a,* chain line) and a second position at which the walls 11 are to a minimum distance from each other (FIG. 3*b,* chain line). In the first position the volume of space 10 is maximum, while in the second position it is minimum.

In terms of sizes, the ratio between the diameter "D" of the space 10 and the thickness "$S_1$" existing between the walls 11 in the first position is included between 4 and 6.

In the example shown, "D" is substantially equal to 85 mm, while "$S_1$" substantially corresponds to 16 mm.

The inner space 10 is marked by a substantially symmetric shape with respect to a horizontal symmetry plane "P".

In the embodiment herein described, the metering device 3 comprises an upper horizontal wall 11*a* and a lower horizontal wall 1*b,* these walls 11*a,* 11*b* facing each other.

The movable walls 11 generally consist of two thin and flexible membranes 12 separated from each other by a central frame 13. This frame, in addition to supporting and separating the membranes 12, also defines the inner side surface 10*a* (FIG. 2) of the space 10.

In this example, the frame 13 externally has a square shape and is internally provided with a circular hole 14. The inner side wall of hole 14 constituting the side wall 10*a* of space 10 is rounded and has a convexity facing the inside of the hole 14 itself.

Formed in a first side 13*a* of the central frame 13 is an inlet duct 15 consisting of a threaded hole enabling connection of the metering device 3 with the connecting duct 4 coming from tank 2. Through this inlet duct 15, the ink can flow into the space 10.

A tailpiece 16 of parallelepiped shape is formed on a second side 13*b*, that is preferably but not exclusively opposite to the first one, of frame 13.

Two outlet ducts 17 are formed through the tailpiece 16 and frame 13 and they consist of two first through holes 18 parallel to the extension plane of the frame 13 and two second holes 19 the axes of which are perpendicular to the axes of the first holes 18. The second holes 19 are such conceived that they open into the first holes 18.

Respective plugs (not shown in the figures) are applied to the outer end 18*a* of the first holes 18 so that the ink outflows from the metering device 3 exclusively through the second holes 19 to which the pipes 6 taking the ink into the print heads 7 are connected.

The metering device 3 further comprises a box-shaped coating case 20 having an inner chamber 21 (FIGS. 3*a* and 3*b*) inside which the components of the metering device 3 are contained.

Case 20 consists of the central frame 13 and two closing plates 22. Said plates are superposed on the membranes 12 and the central frame 13. All said components of the metering device 3 are pack-wise tightened by a plurality of screws.

Formed on each inner face 22*a* of the closing plates 22 is a respective recessed portion 23 the shape of which is adapted to house the membranes 12 when the latter are in the first position of maximum mutual distance (FIG. 3, chain line). In more detail, the respective recessed portions 23 and the inner side wall 13*b* of frame 13 define said chamber 21. The membranes 12 that are also fastened to the case 20 by their edges 12*a*, are housed in this chamber 21.

At least one of the closing plates 22 has a pair of facing holes 24 in mutual alignment and each having its axis parallel to the symmetry plane "P". A sensor 25 is disposed inside said holes 24 to determine deformation of the membranes 12.

Herein, this sensor 25 consists of a photoelectric cell capable of sensing the presence or not of a portion of deformed membrane 12 breaking the optical path of the photoelectric cell itself. In detail, the optical path has its initial point at a transmitter 25*a* of sensor 25 and terminates at a receiver 25*b* of sensor 25. Sensor 25 is operatively connected to valve 5.

During the printing step, the valve 5 opens and enables a predetermined amount of ink to come out of tank 2. This ink fills the inner space 10 of the metering device 3 and causes an elastic deformation of the membranes 12. In this way, there is an increase in the volume of space 10. The deformed membranes break the optical path of sensor 25 which drives closure of valve 5.

Each print head 7 sucks ink from the metering device 3 and lays it on articles 8. In this way, the metering device 3 is slowly emptied and the membranes 12 tend to go back to their non-deformed position (FIG. 3, solid line) until the optical path of sensor 25 is restored.

Sensor 25 therefore controls opening of valve 5 enabling new filling of the inner space 10 in the metering device 3.

From the point of view of size, the ratio between said thickness "$S_1$" and the thickness "S" between the non-deformed walls 11 is in the range of 1.5 to 2. In the embodiment herein shown, "S" is substantially equal to 10 mm.

The thickness variation of few millimeters enables the ink feeding pressure to the print heads 7 to be maintained substantially constant.

Sometimes, said print heads 7 require cleaning, in particular after many printing cycles. In fact, it may happen that solid residues are formed due to ink drying and contamination of the heads 7 with dust. Thus these residues are to be removed as they inhibit an even ink delivery.

To this aim, the carriage supporting the heads 7 can take a service position away from articles 8, which position is reached by a displacement along the direction "G".

At this position the heads 7 are put close to cleaning means 26 which substantially consists of suction openings 27 mounted on a supporting plate 28 slidably movable between a lowered rest position and a raised work position.

Advantageously, further openings not shown can be provided to deliver compressed air to the head nozzles, to help separation of the dry ink and promote suction of same by the suction openings 27. The compressed air, associated or not with the sucked air, enables a more efficient removal of the solid residues accumulated on the heads 7.

Typically, the cleaning means 26 contemplates one suction opening 27 associated with each print head 7.

During the cleaning step, the carriage is shifted to the service position and the supporting plate 28 is shifted to the work position. In this way, the suction openings 27 comes into contact with the heads 7 without touching the nozzles of same. In particular, each suction opening 27 has an edge 27*a* resting against the respective head 7 around the nozzles preferably sealingly, so that suction of all the residues is ensured (FIG. 1).

The cleaning action on the heads 7 can be advantageously improved due to high-pressure ejection of a given amount of ink.

To this aim, on each of the closing plates 22 of case 20 of the metering device 3, close to the respective centres, a threaded hole 29 is formed to which respective ducts 30 are applied that are able to carry pressurised air. In fact, during the cleaning step, the delivered air causes a pressure increase in the portion of chamber 21 not taken up by the inner space 10. The generated pressure acts on the membranes 12 that in this way are moved close to each other. As a result, the movable walls 11 take the second position of minimum mutual distance and the volume of space 10 is drastically and quickly reduced so that the ink is urged out at a relatively high pressure and speed (FIG. 3*b*, chain line).

The ink under pressure reaches the heads 7 and co-operates to removal of the solid residues impairing the print quality. The pressurised ink coming out of the heads together with the residues is collected by the cleaning means 26 and disposed of.

The device 1 is advantageously mounted on an ink-jet printing apparatus 31 to carry out printing of articles 8 preferably but not exclusively made of plastic material (FIG. 4).

This printing apparatus 31 comprises, as already mentioned, at least one print head 7 for each colour used. In the example herein shown, the printing apparatus 31 involves a four-colour process and on the whole uses five inks of different colours (black, magenta, cyan, yellow and a colour designed to constitute the background, such as white). It is however possible for an ink to feed more than one head.

In more detail, the present printing apparatus 31 comprises six main print heads 7*a* for a four-colour printing process and two further auxiliary heads 7*b* for printing of the white base.

The articles 8*a* intended for printing lie on a support or tray 9 movable in a reciprocating motion along the printing direction "F". The support 9 is positioned along a central straight guide 32 extending in the longitudinal extension of the printing apparatus 31. The support 9 is moved by a suitable linear motor (not shown). The straight guide 32 is supported by a base "B" of the printing apparatus 1 itself.

All the print heads 7 are housed on a carriage 33 movable in the direction "G" perpendicular to the print direction "F" along suitable parallel slides 34.

In more detail, all heads 7 are aligned in parallel to the printing direction "F". The auxiliary heads 7*b* are out of alignment relative to the main heads 7*a* so that, during each passage of articles 8 under the heads 7, the background ink band advances that of the coloured ink. In other words, the coloured ink band does not fully cover the background ink band, so that repeated passages of the articles 8 under the heads 7 are required.

The printing apparatus 31 further comprises at least one device 35 for radiation drying mounted on a supporting structure (not shown). The drying device 35 is necessary for quick drying of the laid ink. In the proposed embodiment, the printing apparatus 31 comprises two drying devices 35.

One of the drying devices 35 is placed between the auxiliary heads 7*b* and the main heads 7*a* and mainly performs the function of drying the white background ink band.

The other drying device 35 is on the contrary disposed past the main heads 7*a*. It is mainly entrusted with the task of drying the coloured ink band.

The articles 8 are loaded and unloaded from the support 9 by suitable handling means 36 that preferably comprises a movable frame 37. The movable frame 37 consists of two parallel bars 38 connected by a plurality of crosspieces 39. Disposed along said bars 40 is suitable grip means 42 preferably although not exclusively consisting of suction outlets.

The printing apparatus 31 further comprises a first loading conveyor belt 41 connected to a first loading magazine 42 containing the articles 8*a* to be printed, i.e. on which ink is to be laid, and a second unloading conveyor belt 43 connected to a second unloading magazine 44 in which the already printed articles 8*b* are stored.

Extending between the loading conveyor belt 41 and the unloading conveyor belt 43 is said linear guide 32 so that the support 9 can be brought to an intermediate position between the loading conveyor belt 41 and the unloading conveyor belt 43.

Said frame 37 is movable in a horizontal direction between a first position, at which one of the bars 38 is in superposed relationship with the loading belt 41 and a second position at which the other bar 38 is in superposed relationship with the unloading belt 43. The frame 37 is also movable in a vertical direction between a raised position and a lowered position.

In the loading and unloading steps, the frame 37 takes up the first horizontal position, so that one bar 38 is on the articles 8*a* to be printed disposed on the loading belt 41, and the other bar 38 is on the printed articles 8*b* laid on the support 9.

The movable frame 37 moves downwards and the grip means 40 is actuated to grasp the articles 8 that are raised simultaneously with the frame 37.

Subsequently, the frame 37 is shifted to the second horizontal position at which the bar 38 carrying the articles 8*a* to be printed is over the support 9, and the bar 38 carrying the printed articles 8*b* is over the unloading conveyor belt 43.

Finally, the frame 37 moves downwards and deactivation of the grip means 40 occurs. In this way, the articles 8*a* to be printed lie on the support 9 and the printed articles 8*b* lie on the unloading conveyor belt 45.

Said handling means 36 further comprises a cross structure 45 ensuring connection between the magazines 42, 44 and the conveyor belts 41, 43. The cross structure 45 is provided with grip means (not shown in the figures) that generally consists of suction outlets. The cross structure 45 is movable in a vertical direction and is driven in rotation about its substantially vertical axis due to a respective motor, not shown. The cross structure 45 is provided with four arms 46 and carries out loading and unloading of the articles onto and from the conveyor belts 41, 43. First of all, the cross structure 45 grasps a printed article 8*b* from the unloading conveyor belt 43, by means of the grip means, as well as an article to be printed 8*a* from the loading magazine 42. After a 180° rotation, the cross structure 45 releases the article to be printed 8*a* onto the loading conveyor belt 41 and the printed article 8*b* into the unloading magazine 44. Simultaneously, the cross structure 45 grasps a printed article 8*b* again from the unloading conveyor belt 43 and an article to be printed 8*a* from the loading magazine 42.

The loading magazine 42 and unloading magazine 44 each comprise a revolving plate 47 provided with a plurality of seats adapted to support the articles 8. In the specific example, said articles 8 consist of optically readable discs such as CD's or DVD's and the necessary seats to carry them are defined by vertical rods 48.

All the apparatus functions are advantageously controlled and driven by a processing unit, not shown.

The present invention achieves the intended purposes and has important advantages.

First of all, an ink-feeding device for ink-jet printing apparatus as the described one ensures a print quality that is constant in time also on decreasing of the level of the ink contained in the tank 2.

In fact, due to the arrangement of the metering device 3 between the tank 2 and heads 7, the pressure at which the ink enters the heads 7 can be maintained substantially constant, as this pressure is independent of the height of the ink column in tank 2.

By virtue of the prevailingly planar extension of the inner space 10, the ink height is reduced and also reduced is the ink variation in height due to consumption. In this way, the hydrostatic pressure variation exerted by the ink column in the space 10 is negligible and, also due to the presence of valve 5, the level of the ink content in tank 2 is irrelevant.

Therefore the print quality is not at all affected by the decreasing of the ink amount as printing is progressing.

A further advantage is concerned with cleaning of the heads 7 carried out by the suction openings 27. In addition, introduction of compressed air into the metering device 3 and the consequent exit of ink under pressure greatly facilitates removal of the solid residues that are formed for instance due to ink drying or to the presence of dust.

The invention claimed is:

1. An ink-feeding device for ink-jet printing apparatus, comprising:

an ink-containing tank (2);

at least one print head (7) connected to the tank (2), wherein it further comprises a metering device (3) interposed between the tank (2) and the print head (7) and having an inner space (10) with a prevailingly planar extension and a varying volume which is adapted to keep the pressure of the ink feeding the print head (7) substantially constant;

wherein the metering device (3) comprises an upper wall (11*a*) consisting of a flexible membrane (12) and a lower wall (11*b*) consisting of a flexible membrane (12), said walls (11*a*, 11*b*) delimiting the inner space (10), each flexible membrane (12), in a non-deformed position, lying in a plane;

wherein each of the flexible membranes (12) is deformable out of the respective plane between a first configuration, in which said walls (11*a*, 11*b*) are at a maximum mutual distance from each other and the varying volume is maximum, and a second configuration, in which said walls (11*a*, 11*b*) are at a minimum mutual distance from each other and the varying volume is minimum;

wherein the metering device (3) further comprises a box-shaped case (20), said case (20) being provided with an inner chamber (21) inside which said flexible membranes (12) are housed;

wherein said flexible membranes (12) are fastened to the case (20) by their edges (12*a*).

2. A device as claimed in claim 1, wherein the inner space (10) has a substantially symmetric conformation relative to a horizontal plane (P).

3. A device as claimed in claim 2, wherein it comprises at least one outlet duct (17) placed at a position substantially close to the horizontal plane (P).

4. A device as claimed in claim 1, wherein it further comprises a valve (5) interposed between the tank (2) and the metering device (3).

5. A device as claimed in claim 4, wherein the metering device (3) comprises a sensor (25) to detect ink emptying of the inner space (10), said sensor (25) being operatively connected to the valve (5) and driving opening of same upon emptying of the inner space (10), so that said space is filled of ink again.

6. A device as claimed in claim 5, wherein the sensor (25) comprises a photoelectric cell.

7. A device as claimed in claim 5, wherein the sensor (25) is disposed on the case (20) and faces the inside of the chamber (21).

8. A device as claimed in claim 1, further comprising at least one duct (30) under pressure connected to the case (20) and opening into the chamber (21) out of the inner space (10) to enable compression of the membranes (12) and at least partial emptying of the space (10).

9. A device as claimed in claim 8, further comprising a duct (30) under pressure opening into the chamber (21) out of the inner space (10) and associated with the upper horizontal wall (11*a*), and a further duct (30) under pressure opening into the chamber (21) out of the inner space (10) and associated with the lower horizontal wall (11*b*).

10. A device as claimed in claim 1, wherein the case (20) comprises two closing plates (22) in superposed relationship with the membranes (12).

11. A device as claimed in claim 10, wherein formed on each inner face (22*a*) of the plates (22) is a respective recessed portion (23) confining the inner chamber (21).

12. A device as claimed in claim 1, further comprising means (26) for cleaning the print head (7).

13. A device as claimed in claim 12, wherein the cleaning means (26) comprises delivery openings associable with each print head (7).

14. A device as claimed in claim 13, wherein the cleaning means (26) comprise suction openings (27) associable with each print head (7).

15. A device as claimed in claim 14, wherein each suction opening (27) has an edge (27*a*) to be placed around nozzles of the head (7) to ensure suction of all residues.

16. A device as claimed in claim 14, wherein each suction opening (27) faces each print head (7) during the cleaning step.

17. An ink-jet printing apparatus, comprising at least one ink-feeding device as claimed in claim 1.

18. A printing apparatus as claimed in claim 17, further comprising a base (B), a support (9) movable in a printing direction (F) and carrying the articles (8*a*) to be printed, a carriage (33) movable in a direction (G) perpendicular to the printing direction (F), at least one drying device (35) placed beside the head (7) of the feeding device (1).

19. An ink-feeding device for ink-jet printing apparatus, comprising:

an ink-containing tank (2);

at least one print head (7) connected to the tank (2), wherein it further comprises a metering device (3) interposed between the tank (2) and the print head (7) and having an inner space (10) with a prevailingly planar extension which is adapted to keep the pressure of the ink feeding the print head (7) substantially constant;

wherein the inner space (10) has a varying volume;

wherein the inner space (10) is defined by walls (11) that are movable between a first position of maximum mutual distance and a second position of minimum mutual distance;

wherein the movable walls (11) comprise an upper horizontal wall (11*a*) and a lower horizontal wall (11*b*);

wherein the movable walls (11) consist of flexible membranes (12);

wherein the metering device (3) further comprises a box-shaped case (20), said case (20) being provided with an inner chamber (21) inside which the membranes (12) are housed;

wherein the case (20) comprises two closing plates (22) in superposed relationship with the membranes (12);

wherein formed on each inner face (22*a*) of the plates (22) is a respective recessed portion (23) confining the inner chamber (21).

* * * * *